US006688140B2

(12) United States Patent
Shibuta

(10) Patent No.: US 6,688,140 B2
(45) Date of Patent: Feb. 10, 2004

(54) WEFT KNITTING MACHINE WITH TRANSFER MECHANISM AND TRANSFERRING METHOD

(75) Inventor: Takekazu Shibuta, Wakayama (JP)

(73) Assignee: Shima Seiki Mfg., Ltd., Wakayama (JP)

( * ) Notice: Subject to any disclaimer, the term of this patent is extended or adjusted under 35 U.S.C. 154(b) by 0 days.

(21) Appl. No.: 10/344,983

(22) PCT Filed: Aug. 13, 2001

(86) PCT No.: PCT/JP01/07005

§ 371 (c)(1),
(2), (4) Date: Feb. 20, 2003

(87) PCT Pub. No.: WO02/16684

PCT Pub. Date: Feb. 28, 2002

(65) Prior Publication Data

US 2003/0159473 A1 Aug. 28, 2003

(30) Foreign Application Priority Data

Aug. 22, 2000 (JP) ..... 2000-251689

(51) Int. Cl.[7] ..... D04B 7/00
(52) U.S. Cl. ..... 66/64; 66/148
(58) Field of Search ..... 66/64, 68, 69, 66/148, 95, 96 R

(56) References Cited

U.S. PATENT DOCUMENTS 5,398,527 A * 3/1995 Hirai et al. ..... 66/148
5,469,717 A * 11/1995 Shibuta et al. ..... 66/69
5,992,184 A * 11/1999 Shibuta ..... 66/64
6,079,231 A 6/2000 Shima
6,109,067 A 8/2000 Shibuta

FOREIGN PATENT DOCUMENTS

| | | |
|---|---|---|
| CN | 1236031 A | 11/1999 |
| EP | 955402 A | 11/1999 |
| EP | 959162 A | 11/1999 |
| JP | 11-323703 A | 11/1999 |
| JP | 2995464 B2 | 12/1999 |

* cited by examiner

*Primary Examiner*—Danny Worrell
(74) *Attorney, Agent, or Firm*—Rothwell, Figg, Ernst & Manbeck

(57) ABSTRACT

When a loop is transferred from a transfer jack to a knitting needle of a lower needle bed, a needle hook (21*a*, 21*b*) of the knitting needle (13*a*, 13*b*) is inserted into the loop (88) retained on the transfer jack (57); then the transfer jack is moved forward so that the loop can be pushed to be placed in an advancing and retracting track of the needle hook of the knitting needle; and the slider (19*a*, 19*b*) is moved forward so that the needle hook can be closed by the slider to capture and keep the loop in the needle hook, whereby possible occurrence of drop stitch is prevented to ensure that the loop is transferred from the transfer jack to the knitting needle.

2 Claims, 5 Drawing Sheets

WEFT KNITTING MACHINE WITH TRANSFER MECHANISM AND TRANSFERRING METHOD

TECHNICAL FIELD

The present invention relates to a flat knitting machine with transfer mechanism comprising a transfer jack bed (hereinafter it is referred to as "TRJ bed") in which a number of transfer jacks (hereinafter they are referred to as "TRJ"), each having a loop retaining portion at a front end thereof, are arranged in series and which is arranged over needle beds, and a transfer cam mechanism for transferring the loop between the TRJ of the TRJ bed and the knitting needles of the needle beds, and to a transfer method.

BACKGROUND ART

There exists a flat knitting machine comprising a pair of front and back needle beds holding knitting needles in such a manner as to be advanced and retracted in needle grooves formed on upper surfaces of the needle beds, at least one of which is racked horizontally with respect to the other needle bed, and a TRJ bed located over the at least one needle bed and holding TRJ in such a manner as to freely advance and retract in the grooves formed on an upper surface thereof. This type of flat knitting machine has the capability of transferring a loop between knitting needles of the front and back needle beds as well as between a knitting needle and TRJ, as disclosed, for example, by Japanese Laid-open (Unexamined) Patent Publication No. Hei 6(1994)-257039.

FIG. 5 illustrates the motions of the knitting needle and TRJ at each stage of transferring a loop from TRJ to a knitting needle. In this figure, 101 denotes the knitting needle, 103 denotes the TRJ, and 105 denotes the loop. FIG. 5A illustrates the state immediately prior to the course knitting, in which the TRJ 103, after having received the loop 105 from the knitting needle 101, is advanced to a position over a needle bed gap. In this advanced position of the TRJ, the loop 105 retained on a loop retaining portion 103*a* formed at a front end portion of the TRJ is allowed to be transferred from the JRJ to the knitting needle.

In FIG. 5B, the knitting needle 101 of the front needle bed is advanced and inserted into the loop 105 retained on the loop retaining portion 103*a* of the TRJ 103, to receive the loop 105. Then, as shown in FIG. 5C and FIG. 5D, the TRJ 103 is retracted from the advanced position, to release the loop 105 from the TRJ 103 and put the loop 105 on the knitting needle 101. FIG. 5E shows the state in which the transfer of the loop 105 is completed as a result of the knitting needle 101 being retracted and thereby the loop 105 being captured by a needle hook 101*a* of the knitting needle 101.

In some cases, when the TRJ 103 retracts from the state shown in FIG. 5C and FIG. 5D, the loop 105 is sometimes slid closer to the retracting TRJ 103, so that when the knitting needle 101 is retracted in the condition shown in FIG. 5E, the needle hook 101*a* sometimes fails to capture the loop 105 to produce a drop stitch 105*a*. There are some probable factors for the drop stitch. For example, in the case where the TRJ has some shape to hinder the loop 105 from being released smoothly from the loop retaining portion 103*a*, the loop 105 is easily slid closer to the TRJ when retracted. Particularly in the case where a knitting yarn of low stretch is used to knit a fabric, once the loop 103 is slid closer to the TRJ 103, the loop 105 is kept in such a deformed shape without retuning in its original shape even after the TRJ is pulled therefrom and, as a result of this, the drop stitch is produced.

DISCLOSURE OF THE INVENTION

To solve the drawbacks mentioned above, the present invention provides a flat knitting machine with a loop transfer mechanism comprising a pair of front and back needle beds, on which knitting needles, each comprising a needle body having a needle hook at a front end thereof and a slider movable relative to the needle body to close the needle hook, are held in such a manner as to freely advance and retract, and at least one of which is racked laterally with respect to the other needle bed, and a TRJ bed, provided over the at least one needle bed and holding TRJ in such a manner as to freely advance and retract, the flat knitting machine with the loop transfer mechanism further comprising: a needle body control portion for controlling the needle body in such a manner that when a loop retained on the TRJ is transferred to the knitting needle of a lower needle bed, the needle body can be advanced to insert the needle hook of the knitting needle into the loop held on the loop retaining portion of the TRJ; a TRJ control portion for controlling the TRJ to move forward so that the loop retained on the loop retaining portion of the TRJ can be pushed to be placed in an advancing and retracting track of the needle hook of the knitting needle; and a slider control portion for controlling the slider to move forward so that the needle hook can be closed by the slider to capture and keep in the needle hook the loop retained on the loop retaining portion of the TRJ pushed by the TRJ control portion.

Also, the present invention provides a transfer method for transferring a loop from TRJ to a knitting needle by using a flat knitting machine with a loop transfer mechanism comprising a pair of front and back needle beds, on which knitting needles, each comprising a needle body having a needle hook at a front end thereof and a slider movable relative to the needle body to close the needle hook, are held in such a manner as to freely advance and retract, and at least one of which is racked laterally with respect to the other needle bed, and a TRJ bed, provided over the at least one needle bed, for holding TRJ in such a manner as to freely advance and retract, wherein when a loop is transferred from the TRJ to the knitting needle of a lower needle bed, the needle hook of the knitting needle is inserted into the loop; then the TRJ is moved forward so that the loop retained on the TRJ can be pushed to be placed in an advancing and retracting track of the needle hook of the knitting needle; and the slider is moved forward so that the needle hook can be closed by the slider to capture and keep the loop in the needle hook.

According to the present invention, when the loop retained on the TRJ is transferred to the knitting needle of the lower needle bed, the needle body of the knitting needle on the loop receiving side is moved forward so that it can run through the loop retained on the loop retaining portion of the TRJ. Sequentially, the TRJ is moved forward by the TRJ control portion so that the loop can be pushed to be placed in the advancing and retracting track of the needle hook. With the loop held in the advancing and retracting track of the needle hook, the slider is moved forward by the slider control portion so that the needle hook can be closed by the slider. As a result of this, even when the loop is slid closer to the TRJ when sequentially retracted for completion of the transfer of loop, since the loop is captured and kept in the closed needle hook, the loop is prevented from being slipped off from the needle hook when the needle is retracted sequentially. Thus, generation of the drop stitch is prevented.

BEST MODE FOR CARRYING OUT THE INVENTION

In the following, a certain preferred embodiment of a flat knitting machine with transfer cam mechanism and a transfer method of the present invention will be described with reference to the accompanying drawings.

Figure 1:
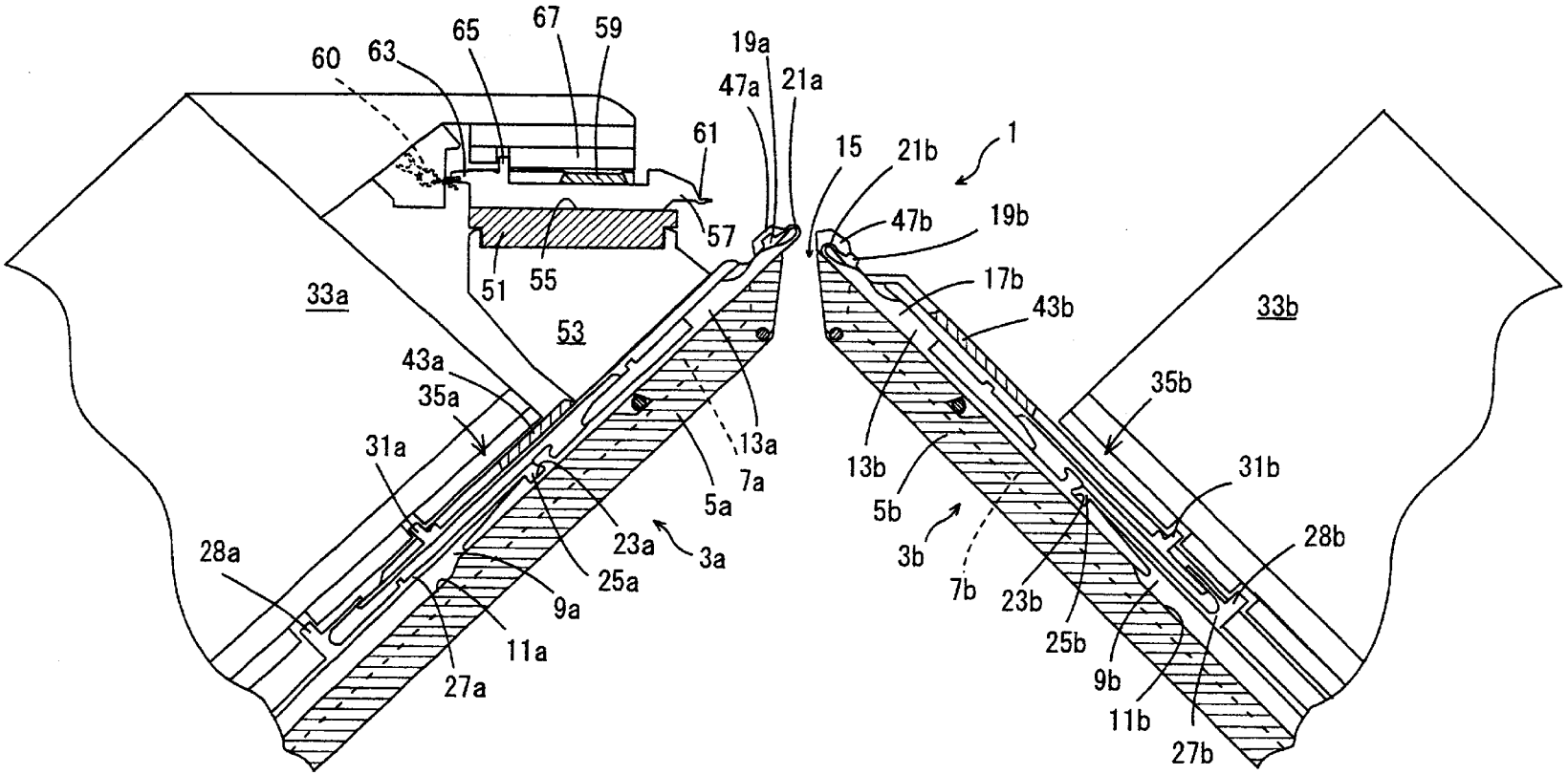
FIG. 1 is a vertical sectional view of a flat knitting machine with a transfer mechanism according to an embodiment of the present invention.

FIG. 1 is a vertical sectional view of the flat knitting machine. The flat knitting machine 1 comprises a pair of front and back needle beds 3*a*, 3*b* placed opposite. The needle beds 3*a*, 3*b* are provided with needle plates 9*a*, 9*b* standing in grooves 7*a*, 7*b* formed on base plates 5*a*, 5*b* to form needle grooves 11*a*, 11*b* between adjacent needle plates. Knitting needles 13*a*, 13*a* are accommodated in the needle grooves 11*a*, 11*b* in such a manner as to be advanced toward and retracted from a needle bed gap 15 between the front and back needle beds. The back needle bed 3*b* is so structured as to be racked in the longitudinal direction of the needle bed by drive means, not shown.

In the illustrated embodiment, compound needles 13, each comprising a needle body 17 having a needle hook 21 formed at a front end thereof and a slider 19 movable relative to the needle body 17 in an advancing and retracting direction of the knitting needle to open and close the needle hook 21, are mounted in the needle grooves 11. The needle body 17 has a recessed portion 23 formed at a rear end portion thereof, and the slider 19 has a butt 31. Also, there are provided needle jacks 27, each having a butt 28 and a protrusion 25 which is to be fitted in the recessed portion 23 of the needle body 17 so as to be combined with the needle body 17. The butt 28 of the needle jack 27 and the butt 31 of the slider 19 are structured to be controlled by control cam 35*a*, 35*b* which are mounted on a pair of front and back carriages 33*a*, 33*b* in such a manner as to move in reciprocation. 43*a*, 43*b* denote bands fixed to extend along a longitudinal direction of the needle beds. The bands 43*a*, 43*b* serve to hold the knitting needles in the needle grooves 11. The needle jack 27 is fitted in the needle groove, together with a select jack and a selector, not shown. The butt 28 of the needle jack 27 can be put in a retracted position where the butt 28 is not engaged with the cam on the carriage 33*a*, 33*b* by selectively pressing the needle jack 27 with the presser of the carriage 33*a*, 33*b* toward a direction of the butt 28 of the needle jack 27 being retracted into the needle groove 13.

Sinker plates 47*a*, 47*b* are arranged between the knitting needles 13 and are placed opposite across the needle bed gap 15 between the front and back needle beds 3*a*, 3*b*. The TRJ bed 51 is supported by an extended portion 53 of the needle plate 9*a* fixed to the front needle bed 3*a* which is extended upwardly from a front end portion thereof. The TRJ bed 51 has TRJ grooves 55 which are formed at the same pitch as the pitch of the needle grooves 11 of the needle beds and in which the TRJ 57 are accommodated in such a manner as to freely advance and retract and are held with bands 59. Each TRJ 57 has a loop retaining portion 61 formed at a front end thereof, a selecting butt 63 formed at a rear end thereof, and an advancing-and-retracting motion controlling butt 65 formed to protrude from a portion thereof extending therebetween. The TRJ 57 is engaged with a control cam 67 formed on the carriage 33*a* at a front end portion thereof, to control the advancing and retracting motion of the TRJ. 60 denotes a selecting actuator to selectively act on the butt 63.

Figure 2:
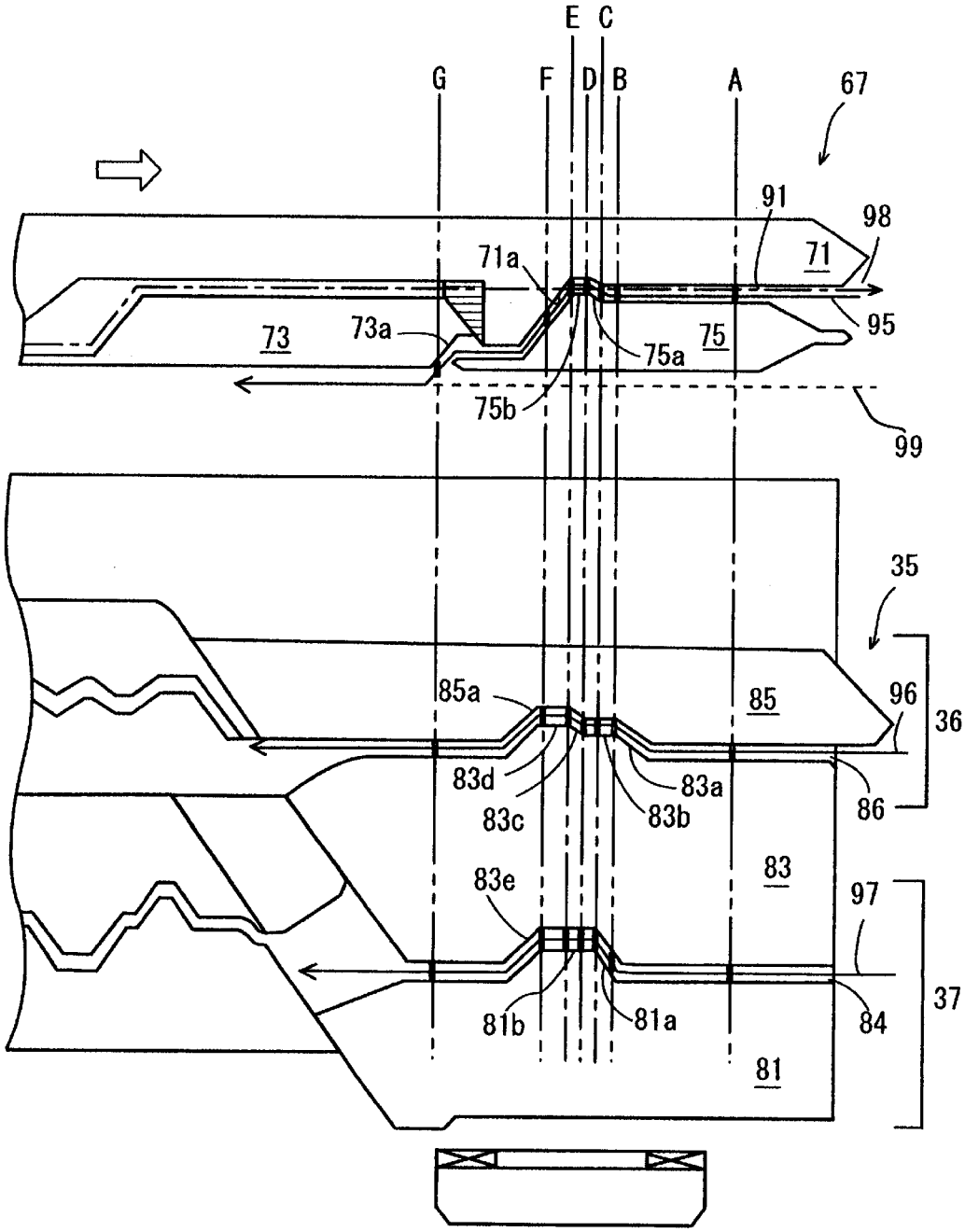
FIG. 2 is a perspective view of control cams, arranged at a carriage, for controlling a TRJ and a knitting needle, which are used when the loop is transferred from the TRJ to the knitting needle.

Now, reference is made to control cams 35, 67, mounted on the carriages 33*a*, 33*b*, for controlling the advancing and retracting motions of the knitting needle 13 and the TRJ 57, with reference to FIG. 2 (front carriage).

The control cam 35 comprises a slider control portion 36 and a needle body control portion 37. Also, the control cam 35 includes guide cams 85, 83, 81 which are arranged in this order from the needle bed gap side. A guide groove 84 having a cam surface for the butt 28 of the needle jack 27 to control the advancing and retracting motion of the needle body is formed between the guide cam 81 and the guide cam 83, and a guide groove 86 having a cam surface for the butt 31 of the slider 19 formed between the guide cam 83 and the guide cam 85.

The slider control portion 36 has, in its guide groove 86, a first raising cam surface 83*a* formed at a front edge of the guide cam 83, a first flat surface 83*b*, a second raising cam surface 83*c*, a second flat surface 83*d*, which extend continuously from the first raising cam surface 83*a*, and a clearing cam surface 85*a* formed at a rear edge of the guide cam 85. The needle body control portion 37 has, in its guide groove 84, a raising cam surface 81*a* formed at a front edge of the guide cam 81, a flat surface 81*b* which extends continuously from the raising cam surface 81*a*, and a clearing cam surface 83*e* formed at a rear edge of the guide cam 83.

The TRJ control portion 67 comprises a guide cam 71 provided at the needle bed gap side and guide cams 73, 75 provided at a rear side of the guide cam 71. A cam groove 91 having a cam surface for controlling the advancing and retracting motion of the TRJ 57 is formed between the guide cam 71 and the guide cams 73, 75. A first raising cam surface 71*a* and a flat surface 75*b* extending continuously from the first raising cam surface 75*a* are formed at a front edge of the guide cam 75, and a clearing cam 71*a* is formed at a rear edge of the guide cam 71. A clearing cam 73*a* formed at a rear edge of the guide cam 73 acts on the butt 65 of the TRJ retracted by the clearing cam surface 71*a* to guide the butt 65 to a further retracted rest position.

The cam surfaces, which are formed on the needle body control portion 37, the slider control portion 36 and the TRJ control portion 67, respectively, are placed substantially in the same phase relation to the advancing direction of the carriage. These cam surfaces act as mentioned later when the loop is transferred from the TRJ to the knitting needle. Depicted in a solid line 95 in FIG. 2 is a route of the butt 65 of the TRJ taken when the loop is transfer from the TRJ to the knitting needle. Depicted in solid lines 96, 97 are a route of the slider butt 31 and a route of the needle jack butt 28, respectively. Depicted in a chain line 98 is a route of the control butt 65 of the TRJ taken when the loop is transferred from the knitting needle to the TRJ. Depicted in a broken line 99 is a route of the butt 65 of the TRJ which is in its retracted position where it is not involved in the knitting.

Figure 3:
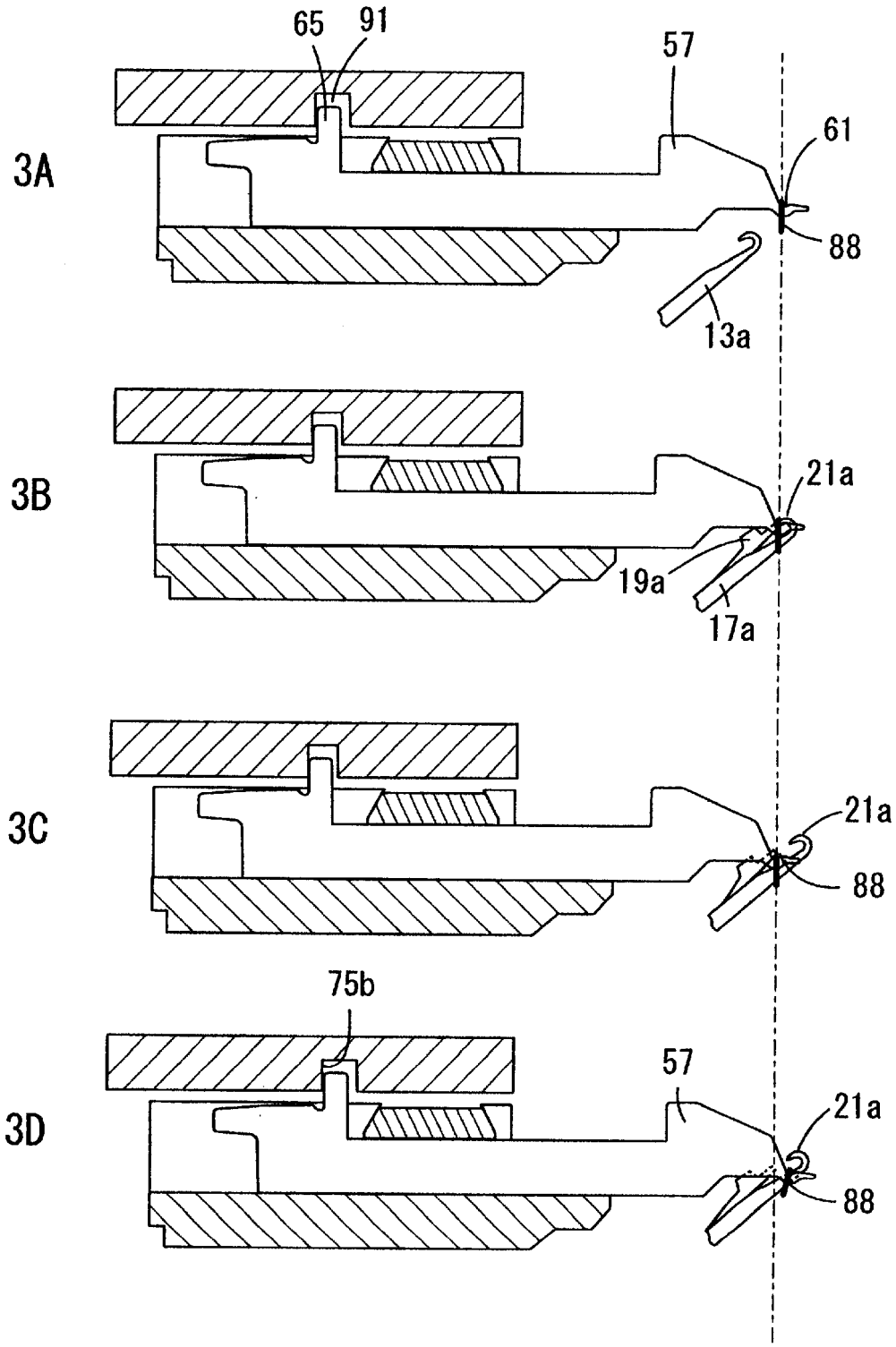
FIG. 3 shows the motions of the knitting needle and the TRJ when the TRJ is in each phase A–D of FIG. 2.
Figure 4:
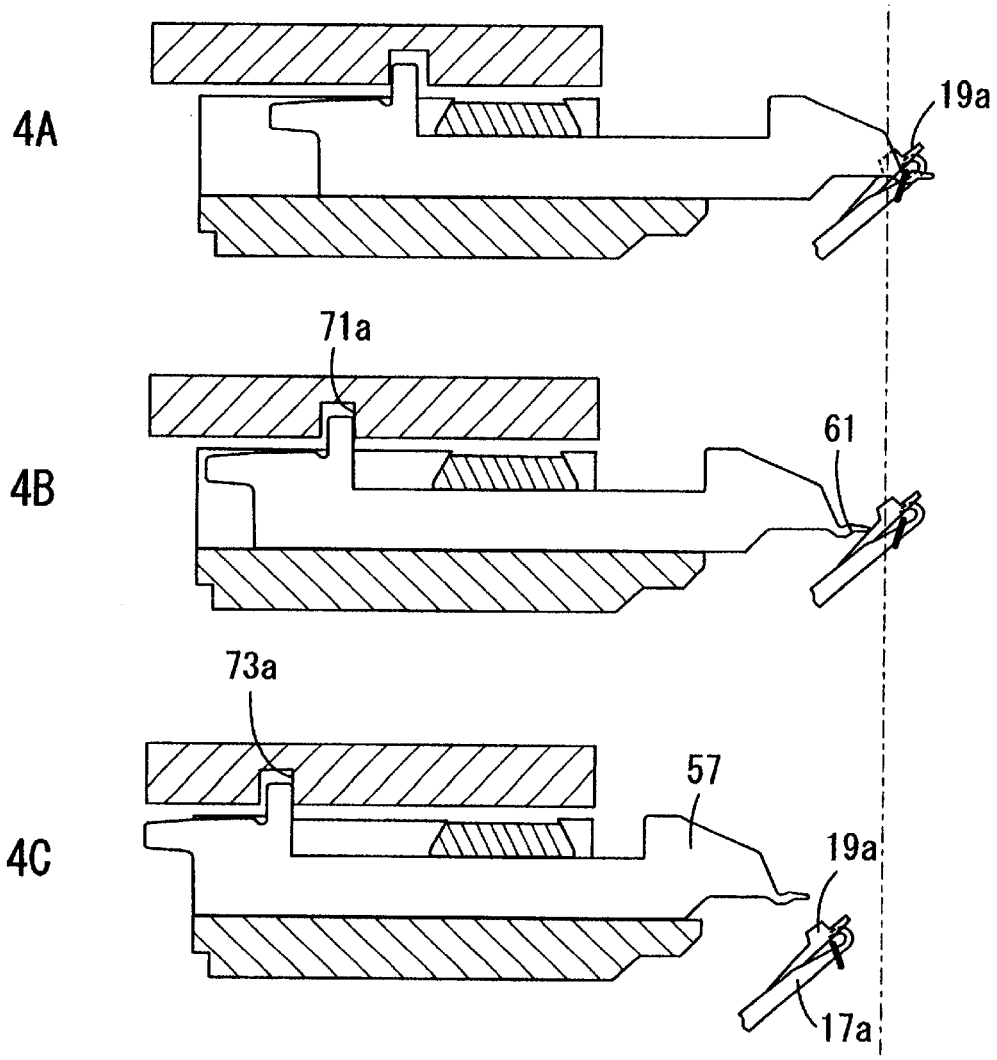
FIG. 4 shows the motions of the knitting needle and the TRJ when the TRJ is in each phase E–G of FIG. 2.
Figure 5:
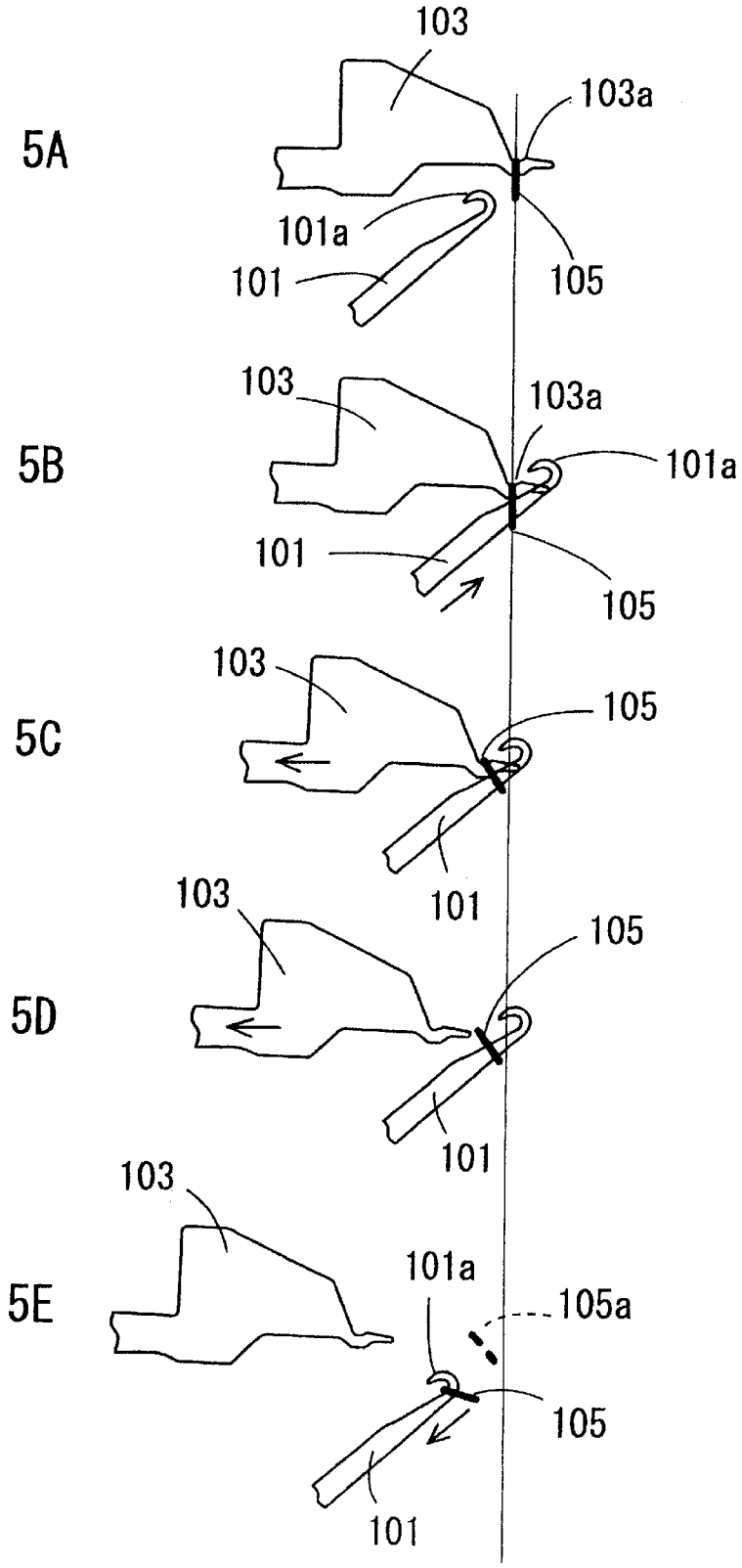
Fig. 5 (PRIOR ART)
FIG. 5 illustrates the motions of the TRJ and the knitting needle when a loop is transferred from the TRJ to the knitting needle in a conventional transfer method.

In the following, the transference of the loop 88 from the TRJ 57 to the knitting needle 13*a* of the front needle bed 3*a* will be described with reference to FIGS. 2–4. This transference is performed in the following processes. After the carriage is moved from right to left, the loop 88 is transferred from the knitting needle to the TRJ, first, and, then, after the front needle bed 3*a* and the TRJ bed 51 are racked relative to each other, the carriage 33 is reversed and moved from left to right, to transfer the loop 88 from the TRJ 57 to the knitting needle 13*a* of the front needle bed 3*a*. The side elevation views of the TRJ 57 and the knitting needle 13*a* placed in the phases A–G shown in FIG. 2 are shown in FIGS. 3A–3D and FIGS. 4A–4C, respectively.

In the phase A of FIG. 2, the TRJ 57 is kept in its advanced position without retracting after the loop 88 is transferred from the knitting needle to the TRJ 57 in the previous course, as shown in FIG. 3A. The loop retaining portion 61 is in the receiving position over the needle bed gap. At this time, the needle body 17*a* of the knitting needle 13*a* and the slider 19*a* are both in their retracted positions.

In the phase B, the butt 28*a* of the needle body 17*a* of the knitting needle 13*a* of the front needle bed 3*a* and the butt 31*a* of the slider 19*a* are engaged with the raising cam surfaces 81*a*, 83*a* to move forward the needle body 17*a* and the slider 19*a*. At this time, a front end portion of the needle hook 21*a* is advanced to a position in which the front end portion of the needle hook 21*a* goes into the loop 88 retained by the loop retaining portion 61 of the TRJ 57. The needle body 17*a* and the slider 19*a* are advanced to a level at which the needle body 17*a* and the slider 19*a* cross the loop retaining portion 61, when viewed from side elevation (FIG. 3B).

In the phase C, the butt 28*a* is raised up to the top of the raising cam surface 81*a*, so that the needle hook 21*a* is advanced further to a higher level than the loop retaining portion 61 and thus the needle hook 21*a* is in a position far beyond an upper end 88*a* of the loop 88 (FIG. 3C).

In the phase D, the TRJ 57 is advanced by the raising cam surface 75*a*, so that the loop 88 is pushed to be placed in an advancing-and-retracting track of the needle hook 21 by a shoulder portion of the TRJ 57 (FIG. 3D).

In the phase E, the TRJ 57 is kept in the phase D position, and the loop 88 is pushed to be placed in the advancing-and-retracting track of the needle hook. In this state, the slider is advanced by the second raising cam surface 83*c* to close the needle hook 21*a* so as to capture and keep the loop 88 in the needle hook (FIG. 4A).

In the phase F, the TRJ 57 is retracted by the clearing cam surface 71*a*, to release the loop 88 from the TRJ 57 (FIG. 4B). At this time, even when the loop 88 is slid closer to the TRJ 57 retraced, since the loop 88 is captured and kept in the needle hook 21*a*, the loop 88 is prevented from being slipped from the needle hook 21*a*.

In the phase G, the needle body 17*a* and the slider 19*a* are already retracted by the clearing cam surfaces 83*e*, 85*a* and the TRJ 57 is also retracted from the needle bed gap 15 by the clearing cam surface 73*a*, whereby the transference of the loop 88 from the TRJ 57 to the knitting needle 13*a* is completed (FIG. 4C).

The embodiment of the flat knitting machine with transfer cam mechanism and the embodiment of the transfer method of the present invention have been described above. As seen from this, the present invention is constructed so that when the loop is transferred from the TRJ to the knitting needle, the TRJ can be pushed toward the needle hook till it reaches the position where the loop is captured by the needle hook and also the slider can be advanced to close the needle hook, so as to prevent the loop retained in the needle hook from being slid off from the needle hook even when the loop is slid closer to the slider when retracted. Hence, the possibility of the drop stitch that may occur in the transference of the loop in the prior art can be eliminated.

Although the embodiment wherein the loop retaining portion of the TRJ is advanced and retracted in the horizontal direction has been illustrated above, the present invention is not limited to this illustrated embodiment. For example, the present invention may be modified so that the loop retaining portion of the TRJ can be swung in its advanced position over the needle bed gap so that when the TRJ is retracted after the needle hook passes through the loop, the loop retaining portion of the TRJ can be swung downwardly as if it bows down. This modification can provide the advantage that the loop can be released more smoothly from the TRJ. Thus, the present invention is also applicable to such modification having the feature of this swingable TRJ.

Capabilities of Exploitation in Industry

According to the present invention, occurrence of the drop stitch can be prevented to ensure the transference of the loop from the TRJ to the knitting needle.

What is claimed is:

1. A flat knitting machine with a loop transfer mechanism comprising a pair of front and back needle beds, on which knitting needles, each comprising a needle body having a needle hook at a front end thereof and a slider movable relative to the needle body to close the needle hook, are held in such a manner as to freely advance and retract, and at least one of which is racked laterally with respect to the other needle bed, and a transfer jack bed, provided over the at least one needle bed and holding transfer jacks in such a manner as to freely advance and retract, the flat knitting machine with the loop transfer mechanism further comprising:

a needle body control portion for controlling the needle body in such a manner that when a loop retained on the transfer jack is transferred to the knitting needle of a lower needle bed, the needle body is advanced to insert the needle hook of the knitting needle into the loop held on the loop retaining portion of the transfer jack;

a transfer jack control portion for controlling the transfer jack to move forward so that the loop retained on the loop retaining portion of the transfer jack is pushed to be placed in an advancing and retracting track of the needle hook of the knitting needle; and a slider control portion for controlling the slider to move forward so that the needle hook is closed by the slider to capture and keep in the needle hook the loop retained on the loop retaining portion of the transfer jack pushed by the transfer jack control portion.

2. A transfer method for transferring a loop from a transfer jack to a knitting needle by using a flat knitting machine with a loop transfer mechanism comprising a pair of front and back needle beds, on which knitting needles, each comprising a needle body having a needle hook at a front end thereof and a slider movable relative to the needle body to close the needle hook, are held in such a manner as to freely advance and retract, and at least one of which is racked laterally with respect to the other needle bed, and a transfer jack bed, provided over the at least one needle bed, for holding transfer jacks in such a manner as to freely advance and retract, said method comprising:

transferring a loop from the transfer jack to the knitting needle of a lower needle bed;

inserting the needle hook of the knitting needle into the loop;

then moving the transfer jack forward so that the loop retained on the transfer jack is pushed to be placed in an advancing and retracting track of the needle hook of the knitting needle; and moving the slider forward so that when the needle hook is closed by the slider, the loop is captured and kept in the needle hook.

* * * * *